US006422689B1

(12) United States Patent
Moon et al.

(10) Patent No.: US 6,422,689 B1
(45) Date of Patent: Jul. 23, 2002

(54) INKJET PRINT HEAD

(75) Inventors: Jae-ho Moon, Seoul; Dae-soon Lim, Yongin, both of (KR)

(73) Assignee: Samsung Electronics Co., Ltd., Suwon (KR)

( * ) Notice: Subject to any disclaimer, the term of this patent is extended or adjusted under 35 U.S.C. 154(b) by 0 days.

(21) Appl. No.: 09/736,277

(22) Filed: Dec. 15, 2000

(30) Foreign Application Priority Data

Jul. 20, 2000 (KR) ..... 00-41744

(51) Int. Cl.[7] ..... B41J 2/05
(52) U.S. Cl. ..... 347/65
(58) Field of Search ..... 347/9, 20, 50, 347/56, 61, 65, 87

(56) References Cited

U.S. PATENT DOCUMENTS 3,808,399 A * 4/1974 Payne et al. ..... 219/216
5,648,806 A * 7/1997 Steinfield et al. ..... 347/87

* cited by examiner

*Primary Examiner*—Anh T. N. Vo
(74) *Attorney, Agent, or Firm*—Robert E. Bushnell, Esq.

(57) ABSTRACT

There is provided an inkjet print head including: a substrate; a nozzle plate which forms a space where ink is to be filled between the substrate and the nozzle plate and on which plural orifices for ejecting ink are formed; and heaters which form bubbles to push ink droplets out through the orifices, wherein the heaters are installed on elevation parts elevated from the substrate and inserted into the orifices. According to such a structure, since the orifices for ejecting ink droplets, themselves, act as partition members against adjacent heaters, the structure can be greatly simplified. It becomes possible to control the ejection of ink droplets precisely because there is little possibility that reverse flow occurs when bubbles are expanded.

17 Claims, 5 Drawing Sheets

INKJET PRINT HEAD

CLAIM OF PRIORITY

This application makes reference to, incorporates the same herein, and claims all benefits accruing under 35 U.S.C. §119 from my application entitled INK JET PRINTING HEAD filed with the Korean Industrial Property Office on Jul. 20, 2000 and there duly assigned Serial No. 2000/41744.

BACKGROUND OF THE INVENTION

1. Field of the Invention

The present invention relates to an inkjet print head and more particularly, to an inkjet print head, wherein an arrangement structure of heaters that form bubbles is improved.

2. Description of the Related Art

Generally, an inkjet print head is an apparatus for printing images of a prescribed color by ejecting ink droplets to a desired position on a recording paper. However the design of inkjet printheads are plagued by a number of deficiencies. First, when bubbles are being formed at one nozzle, the bubbles are formed in such a way that it creates a backflow along the ink supply line. Second, the process of bubble formation and ejection of ink at one nozzle can affect the quality of bubble formation and ejection at a neighboring nozzle. Thirdly, printheads are difficult to manufacture as it is difficult to align the nozzle plate with the substrate that generates the ink bubbles.

SUMMARY OF THE INVENTION

Accordingly, it is an object of the present invention to provide an improved design for an inkjet print head.

It is also an object to provide a design for an inkjet printhead that eliminates the problem of backflow during bubble formation and during ejection of ink.

It is further an object of the present invention to provide a design of an inkjet printhead where bubble formation and ejection of ink at one nozzle does not affect the performance of bubble formation and ejection at neighboring nozzles.

It is yet another object to provide a design of an inkjet printhead that is easy to manufacture by providing for easy alignment when joining the substrate with the nozzle plate.

Accordingly, to achieve the above object, there is provided an inkjet print head including: a substrate; a nozzle plate disposed on the substrate to form a space where ink is to be filled between the substrates and the nozzle plate, and on which several orifices connected to the ink space are formed to eject ink droplets; and heaters which forms bubbles for pushing ink droplets out through the orifices by heating ink by application of electric current, wherein elevation parts of which the heads are inserted into the orifices are provided, and the heaters are installed on the heads of the elevation parts.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE INVENTION

Figure 1:
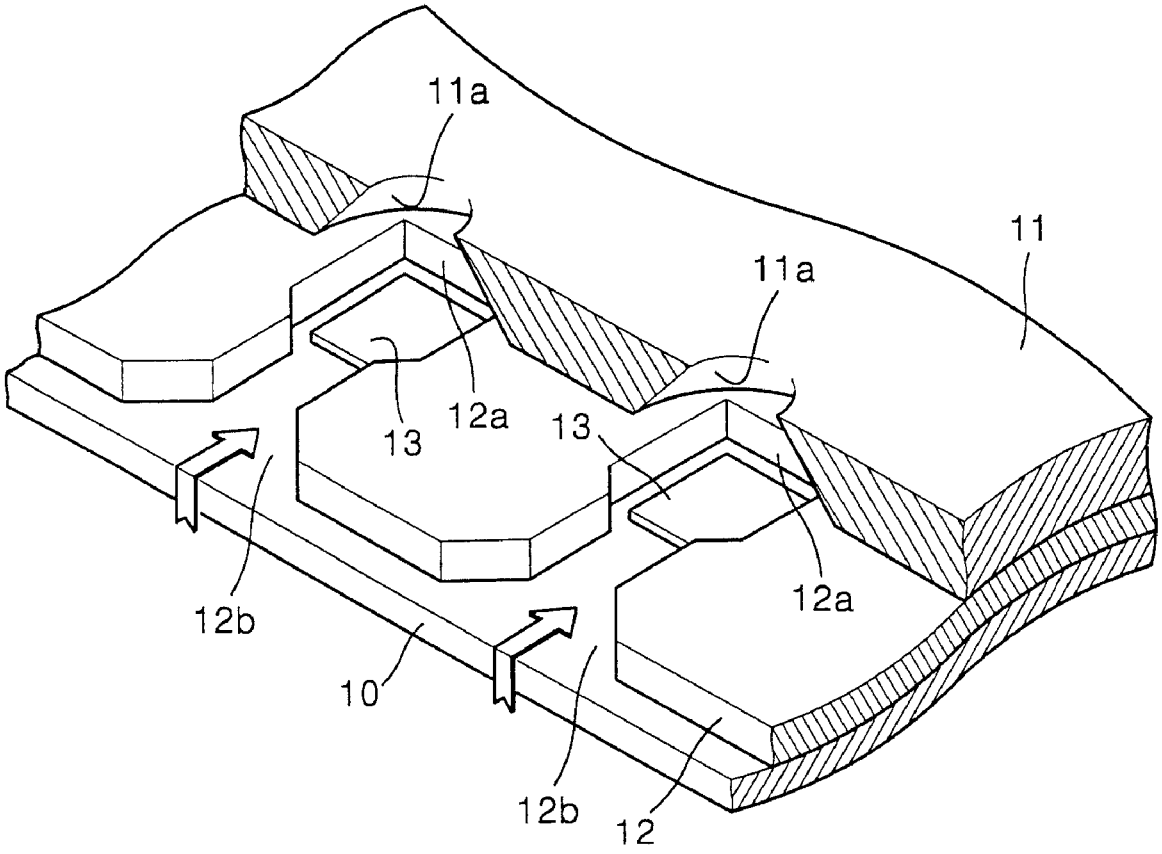
FIG. 1 is a perspective view showing a portion of the inner structure of an inkjet print head.
Figure 2:
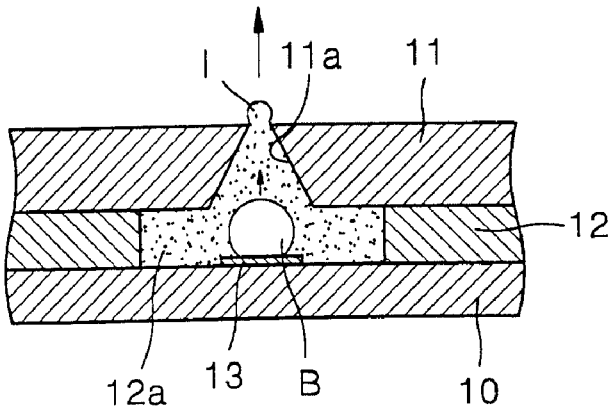
FIG. 2 is a sectional view illustrating the process of ejecting ink droplets out of the print head shown in FIG. 1.
Figure 3:
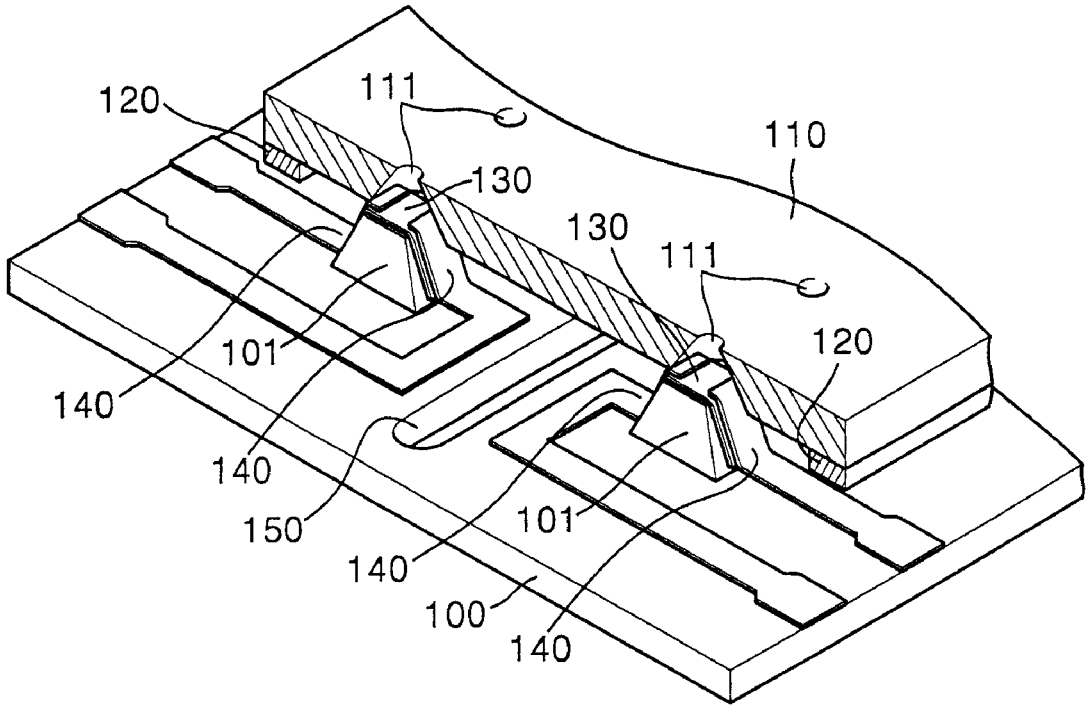
FIG. 3 is a perspective view showing a portion of the inner structure of an inkjet print head according to the present invention.
Figure 4:
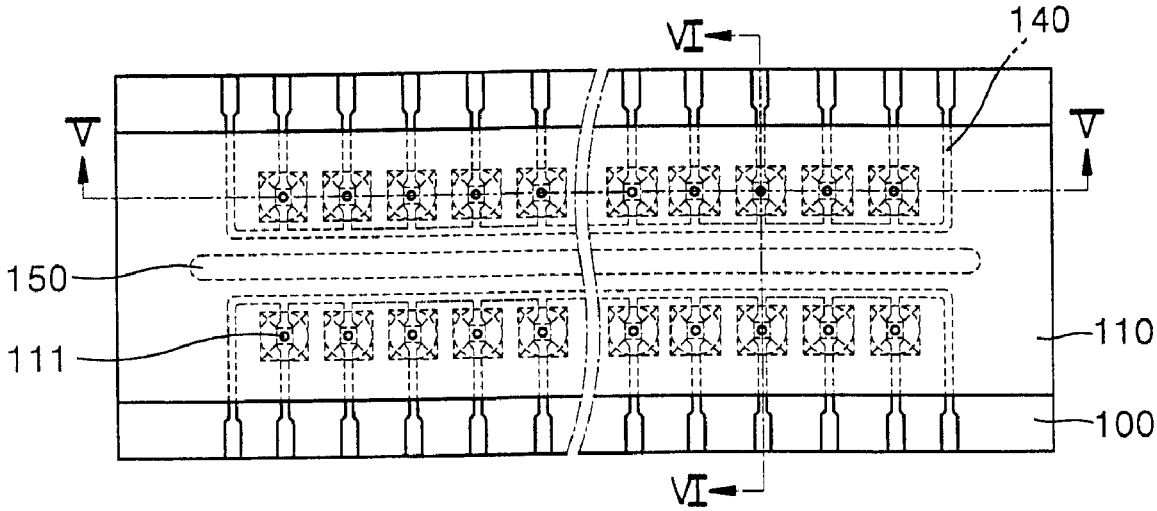
FIG. 4 is a plan view of the inkjet print head shown in FIG. 3.
Figure 5:
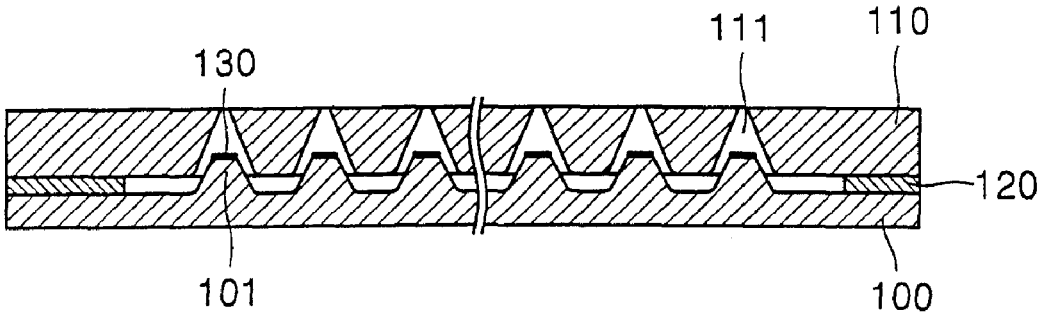
FIG. 5 is a sectional view cut along the V—V line of FIG. 4.
Figure 6:
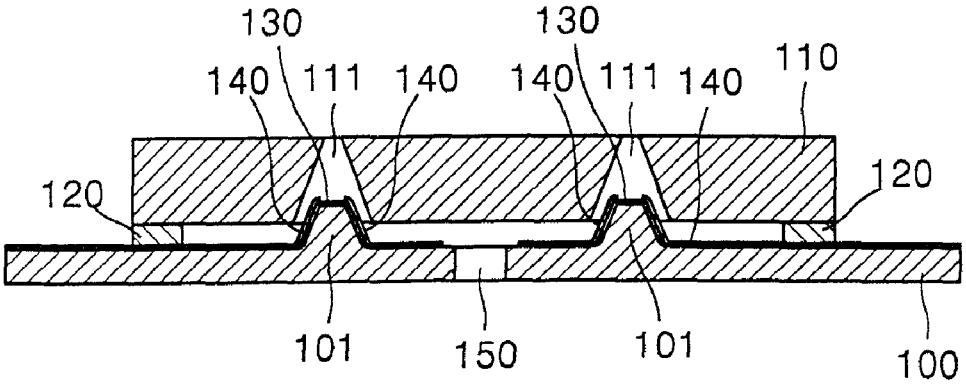
FIG. 6 is a sectional view cut along the VI—VI line of FIG. 4.

As shown in FIG. 1, the inkjet print head includes a substrate 10, partition members 12 which are installed on the substrate 10 and form chambers 12*a* in which ink is filled up, heaters 13 installed within the chambers 12*a,* and a nozzle plate 11 on which orifices 11*a* for ejecting ink are formed. Ink is filled in the chambers 12*a* through fluid inlet tracts 12*b,* and also ink is filled in the orifices 11*a* connected to the chambers 12*a* by the capillarity. If electric current is supplied to the heaters 13 of the above structure, the heaters 13 emit heat and bubbles (B) are formed in the ink in the chambers 12*a* as shown in FIG. 2. Then, pressure is applied to the ink in the chambers 12*a* by the volume expansion of the bubbles (B), and the ink droplets (I) are ejected to the outside through the orifices 11*a* by the pressure.

However, the print head of the above structure must have partition members installed 12 to form the chambers 12*a* separated from each other in order to restrain influences between the adjacent heaters 13, so that it is difficult to simplify the structure any further. Moreover, the pressure generated by the expansion of bubbles (B) within the chambers 12*a* mainly acts push ink out toward the orifices 11*a,* and also generates a reverse flow by pushing ink out toward the fluid inlet tracts 12*b* at the same time. If a reverse flow is generated as above, the amount of ink droplets ejected through the orifices 11*a* differs from the estimated value, so that precise control becomes difficult and the print quality is degraded accordingly.

Referring to FIGS. 3 through 6, an adhesive layer 120 is interposed between a substrate 100 and a nozzle plate 110, thus adhering the nozzle plate 110 to the substrate 100. The adhesive layer 120 may be an adhesive tape. The space between the substrate 100 and the nozzle plate 110 surrounded by the adhesive layer 120 becomes a filling space in which ink droplets supplied through a long fluid inlet hole 150 are filled. Several orifices 111 for ejecting ink droplets are formed on the nozzle plate 110, and heaters 130 for emitting heat connected to electrodes 140 are installed on the substrate 100 within the orifices 111. Here, the main feature of the print head according to the present invention is that the elevation parts 101 on which the heaters are installed are elevated from the substrate 100 and the heads thereof are inserted into the orifices. That is, according to the structure of the present invention, generation of the bubbles and expansion by heat emission by the heaters 130 are performed in the orifices 111. Also, the elevation parts 101 on which the heaters 130 are installed have a square sectional shape, and the orifices 111 have a round conic shape. Therefore, though the elevation parts 101 are inserted and placed in the orifices 111, sufficient gaps (d) for bringing ink into the orifices 111 is ensured. The elevation parts of a square sectional shape can be formed by, for example, anisotropic etching, and accordingly, the elevation shape of a square pyramid having a slope angle of 54.7° is obtained. The sectional shape need not be square if the gaps for bring in ink can be ensured when the elevation parts are inserted into the round orifices 111. However, a polygonal shape is preferred over a round shape. Selectively, the orifices 111 are formed in the polygonal sectional shape, and the sectional shapes of the elevation parts 101 can be formed in the round sectional shape or polygonal sectional shape. The thickness of the nozzle plate 110 is about 40–50 $\mu$m, and the height of the elevation parts 101 elevated from the substrate 100 is about 30 $\mu$m. The elevation parts 111 can be formed by one of the processes of plating, sputtering, and evaporating in addition to the anisotropic etching process.

Figure 8A:
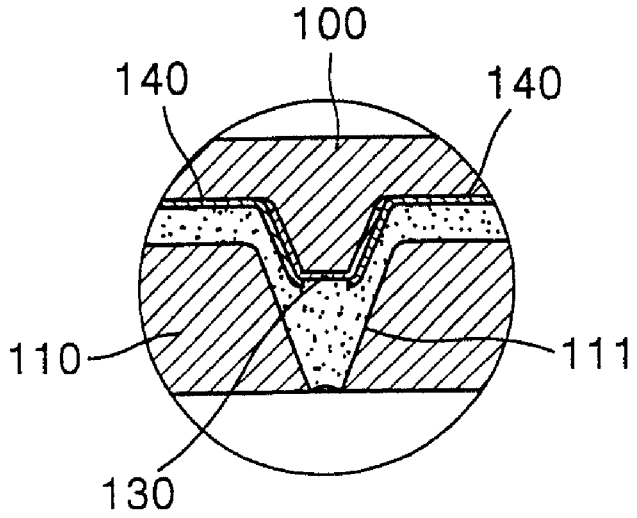
FIGS. 8A through 8D are drawings sequentially showing the process of ejecting ink droplets by the inkjet print head of the present invention.
Figure 8B:
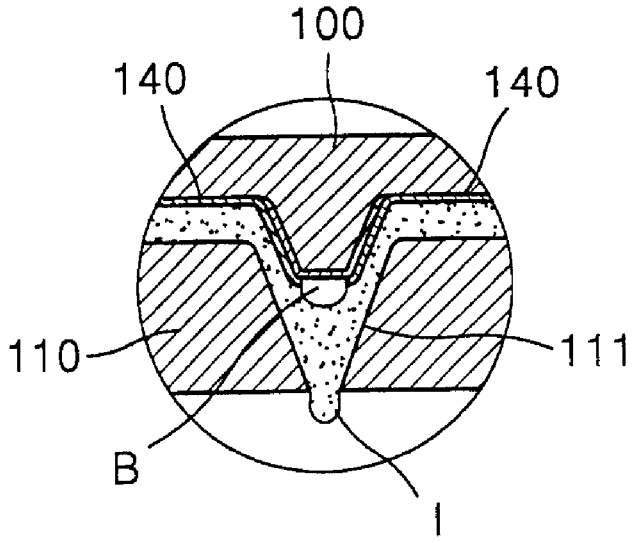
Figure 8C:
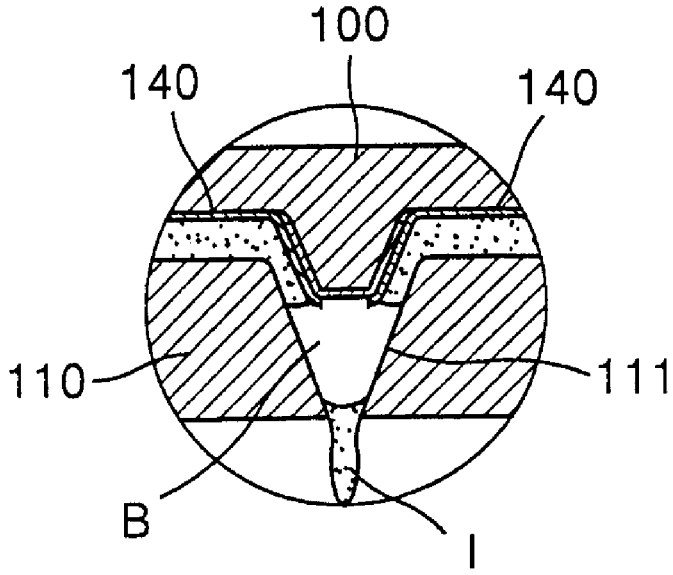
Figure 8D:
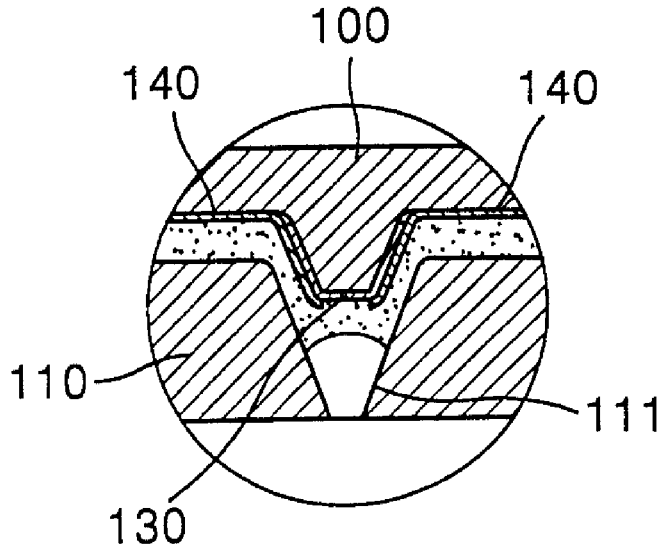

In the above structure, ink supplied through the long fluid inlet hole 150 is filled in the space between the substrate 100 and the nozzle plate 110 and in the orifices 111, as shown in FIG. 8A. Here, the orifices 111 are directed downward, but ink does not spill out of the orifices 111 because of the surface tension. If electric current is supplied to the heaters 130 through the electrodes 140 in this situation, the heaters emit heat of 400° C. in an instant, and generates bubbles (B), as shown in FIG. 8B. The bubbles (B) increase the pressure caused by volume expansion and pushes the ink droplets (I) out of the orifices 111. After this, when all the ink droplets are completely ejected by the expansion of the bubbles (B), as shown in FIG. 8C, ink is filled again in the empty space, as shown in FIG. 8D.

In the process of ejecting ink droplets by the print head of the present invention, the heaters 130 are inserted into the orifices 111, and the generation of the bubbles (B) is also performed in the orifices 111, so that the orifices 111, themselves, act as partition members which prevent the influences of adjacent heaters 130. Accordingly, without installation of the partition members, influences, such as an intentional ejection of ink caused by adjacent heaters, are satisfactorily blocked.

Figure 7:
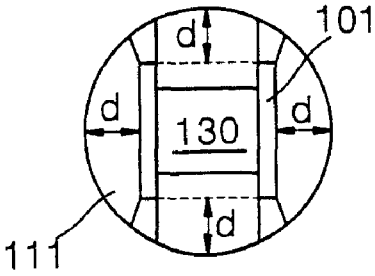
FIG. 7 is a plan view showing gaps formed between the inner walls of the orifices and the elevation parts.

In addition, after the bubbles (B) are generated in the orifices 111, the ink droplets (I) are expanded in the direction of the ejection, so that there is very little possibility that reverse flow of ink in the opposite direction can occur. That is, when the bubbles (B) are first generated and begin to expand, as shown in FIG. 8B, some ink can flow backward and be pushed out through the gaps (d in FIG. 7). However, after the bubbles (B) are expanded so that they touch the side walls of the orifices 11, the routes of the reverse flow through the gaps (d) are cut off by the bubbles (B). After this, the bubbles (B) are expanded only in the direction the ink droplets (I) are ejected, as shown in FIG. 8C, so that the ink of the orifices 111 are ejected only to the outside and reverse flow essentially does not occur. The distinguishing feature of this invention is that cross talk can be prevented and print quality can be improved by controlling the ejection of ink precisely.

Also, the structure of the elevating part 101 on which the heaters 130 are installed according to the present invention helps to arrange the nozzle plate 110 easily when installing the nozzle plate 110 on the substrate 100. That is, if both the substrate and the nozzle plate are flat, it is a quite complicated work to align the heaters and the orifices. On the other hand, according to the present invention, the elevation parts 101 are only joined to be inserted into the orifices 111. Therefore, a kind of a self-alignment becomes possible, so that an aligning task can be performed quickly and conveniently, and also the danger offset becomes less.

Moreover, the present preferred embodiments illustrate that the heaters 130 are extended in the top of the heads of the elevation parts 101 to cover the side. However, there is no problem that the heaters 130 are placed only on the top of the heads of the elevation parts 101, or on the contrary, the heaters are extended not only to the top and the side of the elevation parts 101 but also to the edges of the substrate 100 like the electrodes 140. In any case, if the connecting positions of the electrodes 140 of both sides are the same, bubbles (B) are generated in the heads of the elevation parts 101, as shown in FIG. 8B.

As described in detail, since orifices for ejecting ink droplets, themselves, act as partition members against adjacent heaters, the print head according to the present invention is profitable for simplifying the structure, and it becomes possible to control the ejection precisely because there is little possibility that reverse flow occurs when the bubbles are expanded. Also, alignment is convenient when the nozzle plate is installed on the substrate.

Although the invention has been illustrated and described with respect to exemplary embodiments thereof, the present invention should not be understood as limited to the specific embodiments set out above but various changes and modifications may be made by those skilled in the art, without departing from the spirit and scope of the present invention set out in the appended claims.

What is claimed is:

1. An inkjet print head, comprising:

a substrate;

a nozzle plate disposed on the substrate to form a space where ink is to be filled between the substrate and the nozzle plate, and on which a plurality of orifices connected to the space where ink is to be filled are formed to eject ink droplets; and heaters emitting heat which produce bubbles to push ink droplets out through the orifices by heating the ink, wherein elevation parts are provided to be inserted into the orifices on the substrate, and the heaters are installed on the heads of the elevation parts.

2. The inkjet print head of claim 1, wherein the elevation parts are formed in one body with the substrate.

3. The inkjet printhead of claim 1, the elevation parts being formed by a process selected from the group consisting of etching, plating, sputtering, and evaporating.

4. The inkjet print head of claim 1, wherein the orifices have a round conic shape, and the elevation parts inserted into the orifices have a polygonal sectional shape.

5. The inkjet print head of claim 1, wherein the orifices have a polygonal sectional shape, and the elevation parts inserted into the orifices have one of the round sectional shape and polygonal sectional shape.

6. The inkjet print head of claim 1, wherein the heaters are extended in the top of the heads of the elevation parts and disposed to cover the side of the elevation parts.

7. An inkjet printhead, comprising:

an essentially flat substrate, said substrate comprising a plurality of protrusions at regular intervals extending from said substrate, tips of each of said plurality of said protrusions being essentially flat;

a nozzle plate that covers said substrate, said nozzle plate designed to accommodate said plurality of protrusions, said nozzle plate being perforated by a plurality of orifices, said orifices being centered on tips of each of said plurality of protrusions when said nozzle plate is joined with said substrate; and a pair of electrodes for each one of said plurality of protrusions, each one of said pair of electrodes terminating at an edge of said tip of each one of said protrusions allowing ink to be heated in the vicinity of said tips of said plurality of protrusions.

8. The inkjet printhead of claim 7, wherein each one of said plurality of protrusions is of the shape of a truncated pyramid.

9. The inkjet printhead of claim 7, wherein each one of said plurality of protrusions is distanced far enough from said nozzle plate to allow ink to flow to each one of said plurality of protrusions.

10. The printhead of claim 7, wherein each one of said plurality of orifices are close enough to each one of said plurality of tips of said protrusions and each one of said plurality of orifices are small enough to cause bubbles generated by said pair of electrodes to expand in a direction of an opening of said plurality of said orifices, thus negating the presence of backflow of ink.

11. The inkjet print head of claim 7, wherein the plurality of protrusions are formed in one body with the substrate.

12. The inkjet printhead of claim 7, the elevation parts being formed by a process selected from the group consisting of etching, plating, sputtering, and evaporating.

13. An inkjet printhead, comprising:

a substrate having an essentially flat base, said substrate comprising bumps at regular intervals, each one of said bumps having a flat top surface whose surface is parallel to said flat base;

a plurality of electrodes, wherein two electrodes of opposite polarity extend to each of said bumps and terminate on said flat top surface of said bumps to heat ink located on said tops of said bumps;

a nozzle plate designed to mate with said substrate comprised of said bumps, said nozzle plate being perforated by a plurality of orifices, each orifice being positioned at one of said flat top surfaces of one of said bumps; and a plurality of ink channels designed to deliver ink to each one of said top surfaces of said bumps on said substrate.

14. The inkjet printhead of claim 13, bubbles are formed on a layer of resistive heating element disposed between said two electrodes at said top surfaces of said bumps.

15. The inkjet printhead of claim 14, wherein said orifices are small enough and properly positioned to cause said bubbles formed between said two electrodes to expand in a direction towards an outside of said nozzle plate.

16. The inkjet printhead of claim 13, wherein said bumps take the form of truncated pyramids and form one integrated monolithic unit with said substrate.

17. The inkjet printhead of claim 13, wherein said nozzle plate is joined to said substrate by an adhesive.

* * * * *